United States Patent [19]

Tower

[11] 4,427,062

[45] Jan. 24, 1984

[54] POSITIONING OF DEFLECTION WEDGES

[75] Inventor: Timothy M. Tower, Oak Lawn, Ill.

[73] Assignee: Boart International Limited, Johannesburg, South Africa

[21] Appl. No.: 354,796

[22] Filed: Mar. 4, 1982

[30] Foreign Application Priority Data

Mar. 17, 1981 [ZA] South Africa ..... 81/1757

[51] Int. Cl.[3] ..... E21B 43/00; E21B 34/10

[52] U.S. Cl. ..... 166/113; 166/117.5; 166/318; 166/330

[58] Field of Search ..... 166/113, 104, 318, 330, 166/117.5–117.7; 175/4.51, 79–83; 91/419; 137/38, 498, 348

[56] References Cited

U.S. PATENT DOCUMENTS 3,095,924 7/1963 Frisby ..... 166/113
4,284,136 8/1981 Grabe ..... 166/117.5
4,305,462 12/1981 Eilers et al. ..... 166/117.6

*Primary Examiner*—Ernest R. Purser

*Assistant Examiner*—Thuy M. Bui

*Attorney, Agent, or Firm*—Cushman, Darby & Cushman

[57] ABSTRACT

Deflection wedges are positioned in a generally horizontal drill hole in a predetermined orientation by means of a device which fits on the end of a drill string and is positioned in the hole. The deflection wedges positioned at the end of the device, and the device includes a unit which triggers at the predetermined angular orientation, to indicate that the wedge is correctly oriented. The orientation unit has a through passage for pressure fluid and a transverse passage intersecting the through passage. A blocking member is movable in the transverse passage and at a particular orientation moves along the transverse passage across the through passage. When crossing the through passage, the blocking member is entrained by the pressure fluid flow and moves to a position where it blocks the through passage, thus providing a signal to an operator that the unit is correctly positioned. The wedge is then secured in that position and the device withdrawn from the hole.

10 Claims, 4 Drawing Figures

POSITIONING OF DEFLECTION WEDGES

FIELD OF THE INVENTION

This invention relates to the positioning of deflection wedges in drill holes which are horizontal or have a pronounced horizontal component. Such deflection wedges are normally positioned at the end of a drill string, inserted into the hole, orientated to give the correct deflection and then severed from the drill string, for example by shearing a shear pin. When next a drilling bit is inserted in the hole, the wedge causes the bit to drill at an angle to the axis of the original hole.

BACKGROUND TO THE INVENTION

Our South African patent application No. 78/0917 discloses a method of and a device for positioning a deflection wedge in a drill hole which has a pronounced horizontal component. The positioning device disclosed in this earlier specification makes use of a drop arm which is pivoted at one end and held at the other end by a plate which allows that end of the drop arm to drop at a predetermined angular orientation, in order to trigger a mechanism which prevents further rotation of the wedge.

The use of a drop arm has disadvantages in that it requires a considerable length in which to operate. Also, the trigger mechanism has a number of moving parts and is relatively complex. If the device is to be reset without removal from the drill hole, a return spring is required.

It is an object of the invention to provide a device for positioning deflection wedges in drill holes which has a simple trigger mechanism.

SUMMARY OF THE INVENTION

According to the present invention, there is provided a device for positioning a deflection wedge in a drill hole which has a pronounced horizontal component, the device comprising:

an extension adapted to be secured to the end of a drill string so that at least a part of the extension is free to rotate relative to the drill string;

a pressure fluid operated rotation drive for rotating the rotatable part of the extension;

a deflection wedge detachably carried at the end of the extension; and a wedge orientation unit in the rotatable part of the extension, which unit is adapted to stop operation of the rotation drive upon a preset angular orientation being achieved, the unit comprising a through passage for pressure fluid, a transverse passage intersecting the through passage, and a blocking member movable in the transverse passage such that at a preset angular orientation of the unit, the blocking member drops along the transverse passage to the through passage so that, in use the pressure of fluid passing along the through passage entrains the blocking member which then blocks the through passage.

The preset angular orientation is preferably reached once in each complete revolution of the orientation unit.

The blocking member can be a ball, and the transverse passage may communicate with an annular passage around the through passage, the annular passage including a barrier which the ball cannot pass adjacent the opening of the transverse passage into the annular passage.

The rotation drive is preferably a rifle bar mechanism, one element (preferably the nut) of which is connected to the rotatable part of the extension and the other element (preferably the rifle bar) of which is driven axially, but non-rotatably relative to said one element by means of pressure fluid in order to cause said one element and the part of the extension to which it is attached to rotate. The connection between the rifle nut and the rotatable part is preferably made via a ratchet so that when the rifle bar moves in one direction the rifle nut rotates with the rotatable part, but when the bar moves in the other direction the nut turns relative to the rotatable part which remains stationary.

A clutch may be provided between said one element of the rifle bar mechanism and the part of the extension in which the element is mounted, in order to prevent the device being damaged by excessive applied torques.

Pressure fluid is preferably fed to the device through filters at either end.

The rifle bar mechanism is preferably arranged so that a full stroke of the rifle bar produces less than 360° rotation of the rifle nut. In a preferred embodiment, a full stroke of the rifle bar produces rotation of the rifle nut equal to 1/5 of a revolution.

BRIEF DESCRIPTION OF THE DRAWINGS

The invention will now be further described, by way of example, with reference to the accompanying drawings, in which.

DESCRIPTION OF A PREFERRED EMBODIMENT

Figure 1:
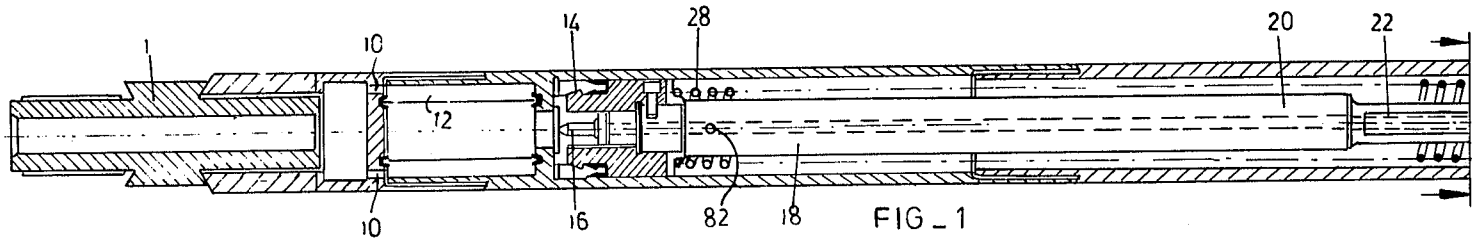
FIGS. 1, 2 and 3 are sequential sections of a device according to the invention; the left hand end of FIG. 2 being a continuation from the right hand end of FIG. 1 and the left hand end of FIG. 3 being a continuation from the right hand end of FIG. 2.
Figure 2:
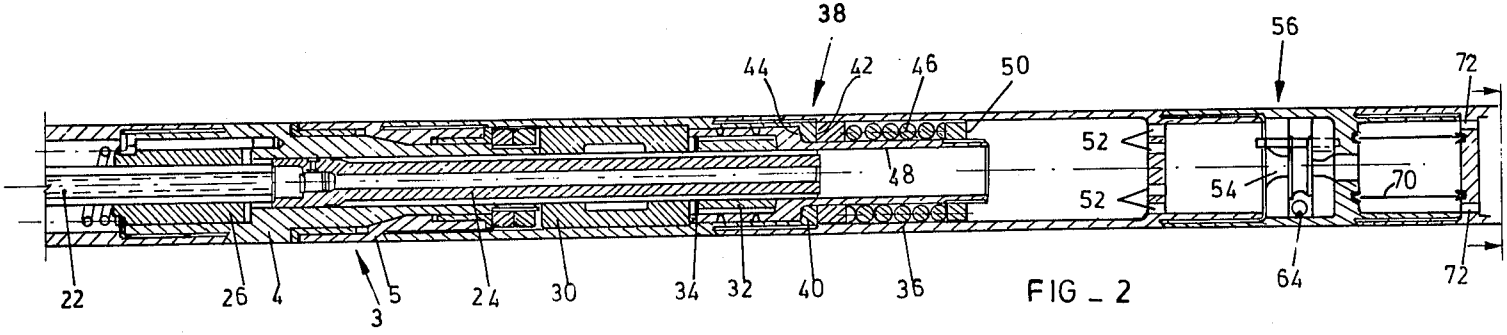

The device shown in the drawings has a coupling sleeve 1 by means of which it can be attached to an end of a drill string, and a deflection wedge 2 which is to be positioned in a drill hole in order to deflect a drill passed down the hole after removal of the device for positioning the wedge.

There is a continuous fluid passage through the device, except after triggering, when flow ceases.

The rotatable part of the device is joined to the non-rotatable part at a junction generally indicated at 3, the non-rotatable part being on the left and bearing reference numeral 4 while the rotatable part is on the right and bears reference numeral 5.

Other components of the device will be described during the following description of its operation.

The device is positioned in a drill hole and a source of pressurised fluid is connected to the central passage. The pressurised fluid passes through openings 10 to the reverse side of a filter screen 12. The fluid then passes through the screen 12 and into contact with the head of a piston 14. The piston 14 has a central orifice 16 communicating with the axial passage through the device. The piston 14 is mounted at the end of a piston rod 18 which has a circular portion 20, and a squared portion 22 connected at its right hand end to a rifle bar 24. The squared section 22 passes through a bush 26 which has a corresponding square aperture preventing rotation of the rod 18. The piston 14 is biased to the left by means of a light compression spring 28 which surrounds the rod 18. When the fluid pressure acting on the head of the piston 14 exceeds a certain level, the piston will be driven to the right by this pressure, thus causing the rifle bar to be driven to the right through a rifle nut which is yet to be described.

The rifle bar is supported centrally inside the casing of the device by means of a support bush 30. To the right of the support bush 30 is a rifle nut 32. This rifle nut is positioned co-axially within a housing 34, and a ratchet (not shown) is provided between the outer surface of the nut 32 and the inner surface of the housing 34 so as to permit rotation of the nut 32 relative to the housing 34 in one direction but not in the other direction.

As the rifle bar 24 moves to the right as a result of fluid pressure on the piston 14, the nut 32 will be turned. When the nut 32 turns in this direction as a result of movement of the rifle bar 24 to the right, the ratchet ensures that the housing 34 also rotates.

The housing 34 is clutched to the rotatable casing 36 of the device by means of a clutch indicated generally at 38. The clutch acts on an inwardly directed flange 40 fast with the casing 36, and friction surfaces 42 and 44 bear against this flange. The friction surfaces are pressed against the flange 40 by means of a spring 46 mounted on an axial extension 48 of the housing 34, and compressed by means of a nut 50 on this extension. Thus, when there is little or no torque resisting rotation of the right hand half 5 of the device, the clutch 38 will engage so that all that part of the device to the right of the joint 3 will rotate when the rifle nut 32 rotates. However if there should be a torque acting on this right hand half of the device resisting rotation with the rifle nut, slip of the clutch 38 may occur to prevent damage to the left hand half of the device.

Figure 4:
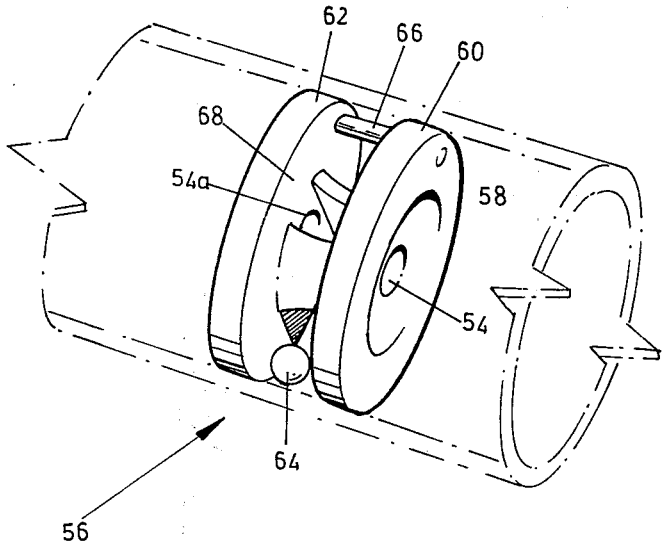
FIG. 4 is a perspective view on a larger scale of a wedge orientation unit used in the device of FIGS. 1, 2 and 3.

All the time the device is in use, fluid is passing along the passage through the center of the device via the central aperture 16 in the piston 14. This fluid now passes through apertures 52 and to a central through passage 54 in a wedge orientation unit 56. This unit is shown more clearly in FIG. 4. The unit is basically in the form of a spool contained within a tubular casing. This spool forms an annular passage 58 around the circumference and between the two ends 60, 62. A ball 64 can travel around this passage, but a peg 66 extends across the passage at one point and prevents the ball from passing. A diametral passage 68 opens at either end into the passage 58 and intersects the central through bore 54. The ball 64 can pass along the length of the passage 68, but cannot pass along the passage 54.

In use, a continuous flow of fluid normally passes through the passage 54. As the unit 56 is rotated, the ball 64 initially stays at the lowermost point. However, eventually the peg 66 comes into contact with the ball 64 and further rotation causes the ball to be lifted up on the peg towards the top of the unit. At a certain point, the ball will fall down the passage 68. However since there is a continuous stream of fluid passing through the passage 54, the ball will be entrained by this flow when it passes the passage 54 and will be driven against the downstream opening of this passage from the passage 68 so as to block the passage 54. When this happens, no more fluid can pass through. This stopping of the fluid flow will be indicated on a flowmeter at surface and will be noticed by an operator of the device who will thus be informed that the orientation unit has triggered. Since the flow through the device is stopped, the spring 28 is now able to move the piston 14 back to its left hand end position. When the piston is moved back in this way, the rifle bar 24 is retracted through the nut 32, but due to the ratchet between the nut 32 and the housing 34 rotation of the nut 32 will not lead to any rotation of the housing 34 or of any of the right hand end of the device.

Downstream of the unit 56 is a second filter unit with a filter element 70 and outlet openings from the filter unit 72. This filter unit is necessary because at times there is a back pressure in the drilled hole which causes fluid to pass in a reverse direction along the device.

Figure 3:
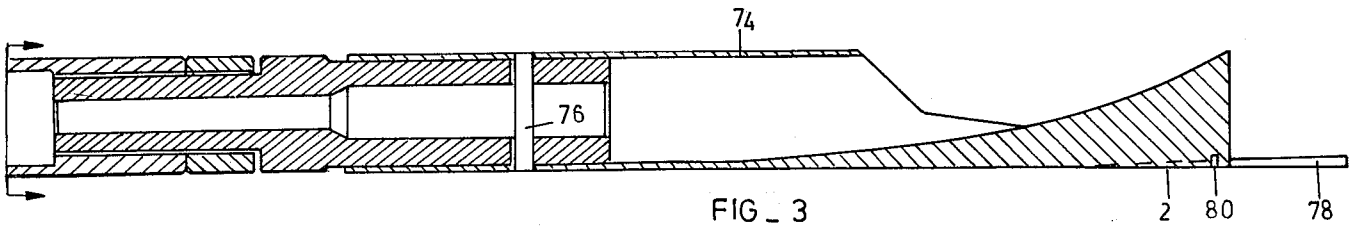

The rest of the device is shown in FIG. 3. The deflection wedge 2 forms part of a sleeve 74 connected to the device by means of a shear pin 76. Also attached to the wedge 2 is a tapered locking wedge 78 which is secured to the wedge 2 by means of a shear pin 80.

The triggering of the wedge orientation unit 56 shows that the wedge is in the correct angular position. The next stage in operation is to exert axial pressure on the drill string and thus on the device to shear the pin 80 and to force the wedge 2 over the wedge 78 to secure the wedge 2 in place in the hole. After further pressure, the pin 76 shears. Now the drill string and the device can be withdrawn from the hole leaving the deflection wedge 2 in place and correctly orientated. A deflected hole can now be drilled.

In the embodiment shown the pitch of the rifling on the rifle bar 24 can be about 750 mm and the maximum length of travel of the piston 14 can be 150 mm, so that each full stroke of the piston 14 produces a rotation of the deflection wedge 2 of 1/5 of a revolution. The amount of rotation that would be necessary to correctly position the wedge will of course depend on the initial position of the wedge in the hole and the desired final position. However when the wedge has to be turned through more than 1/5 of a revolution once it has been placed in the hole, piston 14 will be allowed to return to its initial position after its first full stroke. This will be done by the operator stopping the fluid flow passing through the device to allow the spring 28 to move the piston back to its starting position. Another stroke can then be carried out by reopening the fluid flow on surface.

Also to be noted is the presence of a bleed hole 82 downstream of the piston 14 which equalises pressure on both sides of the piston 14 at low rates of flow.

I claim:

1. A device for positioning a deflection wedge in a drill hole which has a pronounced horizontal component, the device comprising:

an extension adapted to be secured to the end of a drill string so that at least a part of the extension is free to rotate relative to the drill string;

a pressure fluid operated rotation drive for rotating the rotatable part of the extension;

a deflection wedge detachably carried at the end of the extension; and a wedge orientation unit in the rotatable part of the extension, which unit is adapted to stop operation of the rotation drive upon a preset angular orientation being achieved, the unit comprising a through passage for pressure fluid, a transverse passage intersecting the through passage, and a blocking member movable in the transverse passage such that at a preset angular orientation of the unit, the blocking member drops along the transverse passage to the through passage so that, in use the pressure of fluid passing along the through passage entrains the block member which then blocks the through passage.

2. A device as claimed in claim 1, wherein the wedge orientation unit is arranged so that the present angular orientation is reached once in each complete revolution of the unit.

3. A device as claimed in claim 1 or claim 2, wherein the blocking member is a ball and the transverse passage communicates with an annular passage around the through passage, the annular passage including a barrier which the ball cannot pass adjacent the opening of the transverse passage into the annular passage.

4. A device as claimed in claim 1, including filters at either end of the device, in the pressure fluid path through the device.

5. A device as claimed in claim 1, wherein the rotation drive is a rifle bar mechanism including a rifle nut.

6. A device as claimed in claim 5, wherein the nut of the rifle bar mechanism is connected to the rotatable part of the extension and the rifle bar is driven axially, but non-rotatably, relative to the nut by means of pressure fluid in order to cause said one element and the part of the extension to which it is attached to rotate.

7. A device as claimed in claim 6, wherein the connection between the nut and the rotatable part of the extension is made via a ratchet, so that the nut and the extension rotate together in one direction, but the nut rotates relative to the extension in the other direction.

8. A device as claimed in claim 5, wherein a clutch is provided between the rifle nut and the part of the extension in which the nut is mounted.

9. A device as claimed in claim 5, wherein the rifle bar mechanism is arranged so that a full stroke of the rifle bar produces less than 360° rotation of the rifle nut.

10. A device as claimed in claim 9, wherein a full stroke of the rifle bar produces rotation of the rifle nut equal to 1/5 of a revolution.

* * * * *